US005672961A

United States Patent [19]

Entrikin et al.

[11] Patent Number: 5,672,961

[45] Date of Patent: Sep. 30, 1997

[54] TEMPERATURE STABILIZED CONSTANT FRACTION VOLTAGE CONTROLLED CURRENT SOURCE

[75] Inventors: David W. Entrikin; Brent R. Jensen; Benjamin J. McCarroll, all of Portland, Oreg.

[73] Assignee: Maxim Integrated Products, Inc., Sunnyvale, Calif.

[21] Appl. No.: 581,131

[22] Filed: Dec. 29, 1995

[51] Int. Cl.[6] ..... G05F 3/26

[52] U.S. Cl. ..... 323/315; 323/317

[58] Field of Search ..... 363/73; 323/312, 323/315, 907, 316, 317; 327/530, 538

[56] References Cited

U.S. PATENT DOCUMENTS

| | | | |
|---|---|---|---|
| 4,675,594 | 6/1987 | Reinke | 323/30 |
| 4,896,333 | 1/1990 | Can | 375/7 |
| 5,469,047 | 11/1995 | Kumamoto et al. | 323/312 |
| 5,498,953 | 3/1996 | Ryat | 323/315 |

OTHER PUBLICATIONS

Koyama, Mikio et al., "A 2.5V Active Low–Pass Filter Using All–n–p–n Gilbert Cells with a 1–$V_{p-p}$ Linear Input Range," IEEE Nov. 1993, pp. 1–8.

*Primary Examiner*—Adolf Berhane
*Attorney, Agent, or Firm*—Hickman Beyer & Weaver

[57] ABSTRACT

A current source includes a control stage responsive to a stable, d.c. input voltage that is operative to produce a control voltage proportional to absolute temperature (PTAT), and an output stage responsive to the PTAT control voltage that is operative to produce an output current that is an essentially constant fraction of an output constant current source. The control stage includes a temperature-dependent control resistor of a given resistor type, and at least one control constant current source providing the control resistor with a temperature dependent control current. The temperature dependent current source includes a temperature dependent current source resistor based on the given resistor type such that the temperature dependencies of the control current and the control resistor tend to cancel in such a manner that a true PTAT control voltage is developed. The output stage includes an output transistor coupled to an output constant current source such that an output current of the output stage has no current contribution other than from the output current source. A method for providing a current that is a constant fraction of an output constant current source includes the steps of: (a) developing a control current that is based on the same resistor type as a control resistor; (b) applying the control current to the control resistor to develop a control voltage that is proportional to absolute temperature; and (c) applying the control voltage to a current divider coupled to an output constant source to provide an output current.

19 Claims, 3 Drawing Sheets

TEMPERATURE STABILIZED CONSTANT FRACTION VOLTAGE CONTROLLED CURRENT SOURCE

BACKGROUND OF THE INVENTION

This invention relates generally to analog integrated circuits, and more particularly to current sources implemented in analog integrated circuits.

Constant current sources and constant voltage sources are used for a variety of purposes in analog integrated circuits. As used herein, "constant" means that the output of the source remains at a relatively constant direct current (d.c.) level, although the output levels of such sources can typically be adjusted ("set") with a control signal. Once set, the output of a constant current or voltage source may change with temperature (i.e. be "temperature dependent" ) or may be stable with temperature. In many applications, it is desirable to have a constant current or voltage source that does not vary in output as the temperature changes. However, for some applications, it is desirable to have a constant current or voltage source that has an output that is temperature dependent. Useful temperature dependencies include those that are proportional to absolute temperature (PTAT), and those that are complementary to absolute temperature (CTAT).

For example, filters implemented in analog integrated circuits use a number of integrated circuit capacitors. While the relative values of the capacitors tend to match fairly well, the absolute values (i.e. actual capacitances) of the capacitors typically vary ±10% due to process variations during the manufacture of the integrated circuit. Unfortunately, these variances in absolute values of the capacitors cause, for example, a corresponding change in the cut-off frequencies for filters of which they form a part. For example, if the values of the capacitors are at the high end of the tolerance range (i.e. their capacitance is about 10% greater than their nominal capacitance), the cutoff frequency of the filter is too low, and if the values of the capacitors are at the low end of the tolerance range (i.e. their capacitance is about 10% less than their nominal capacitance), the cut-off frequency of the filter is too high.

An adjustable current source can be used to offset these variations in the cut-off frequencies caused by variances in the absolute values of the capacitors as follows. If the values of the capacitors are at the high end of the tolerance range, increasing the current available to flow into the capacitors will increase the cutoff frequency to the desired value. Conversely, if the values of the capacitors are a the low end of the tolerance range, decreasing the current available to flow into the capacitors will decrease the cutoff frequency to the desired value.

If the output of a constant, temperature stable, current source is coupled to an output resistor that is temperature stable, the result is a constant, temperature stable voltage source, as will be appreciated by those skilled in the art. These constant, temperature stable voltage sources are useful for many purposes, such as providing a reference voltage, for adjusting the threshold of a comparator, etc. However, again in some circumstances, it would be desirable to have a constant output voltage source that was temperature dependent for control situations where it is desirable to cancel out the temperature dependencies of the controlled circuit, such as in the control of some variable gain amplifiers.

The prior art teaches both constant current sources and constant voltage sources that can have their outputs adjusted. This is typically accomplished with a "trimmer" resistor, which is essentially a rheostat or variable resistor. Since rheostats cannot be integrated, as a practical matter, into the integrated circuit, these trimmer resistors are provided as discrete, external components. This tends to be expensive, somewhat unreliable, and substantially increases the size of the electronic circuit. It would therefore also be desirable to have a fully integrated, adjustable constant current source and/or constant voltage source which does not require an external trimmer resistor.

The present invention includes a control stage which, in response to the voltage level of a temperature-stable input voltage, produces a PTAT control voltage, and an output stage responsive to the PTAT control voltage which causes a current output which is an essentially constant fraction of an output current source. In a paper entitled, "A 2.5-V Active Low-Pass Filter Using All-n-p-n Gilbert Cells with a 1-$V_{p-p}$ Linear Input Range" by M. Koeyama et al., IEEE Journal of Solid State Circuits, Vol. 28, No. 12, December 1993, a Gilbert cell transconductor is disclosed which also has an input stage and an output stage. The proposed Gilbert cell transconductor is best shown in FIGS. 5 and 8 of M. Koyama et al. However, the circuits proposed by M. Koyama et al. do not serve as constant current sources or constant voltage sources but, rather, as transconductors in the signal path of a circuit. As is well known to those skilled in the art, a Gilbert cell transconductor converts a differential input voltage signal to a differential output current signal. It is, of course, not desirable with a transconductor to have an output that is temperature dependent, as this will distort the signal being transconducted. Furthermore, its use as a transconductor requires a number of complex current sources, such as the two current sources $I_2/2$ (see FIG. 5) whose sum must precisely match the current in the source $I_2$ for the circuit to operate properly. The need to exactly match the sum of the currents in the two current sources $I_2/2$ with the current in current source $I_2$ leads to the complex output stage of M. Koyama et al. as seen in FIG. 8. Since M. Koyama et al. do not desire a temperature dependent current output (and, if fact, desire the opposite), the resistor technologies of the various current sources, including current sources $I_1/2$, $I_2/2$, and $I_2$ are not relevant to their invention.

SUMMARY OF THE INVENTION

The invention is an electrical circuit that adjusts a current source with a stable control voltage. As used herein, "stable" means that the voltage remains essentially unchanged with changes in temperature, i.e. it is not temperature dependent. The circuit solves the problem of providing an adjustable current source whose output is a stable fraction of the total current available, regardless of temperature dependent changes in the total current. In particular, the voltage controlled current source of the present invention is useful for generating scaled versions of a current which changes with temperature, such as one that is proportional to absolute temperature (PTAT).

A temperature stabilized, constant fraction, voltage-controlled current source of the present invention includes a control stage responsive to a stable, d.c. input voltage and which is operative to produce a PTAT control voltage, and an output stage responsive to the PTAT control voltage and operative to produce an output current that is a constant fraction of an output constant current source. The control stage includes a temperature-dependent control resistor of a given resistor type, and at least one control constant current source providing the control resistor with a temperature dependent control current. The temperature dependencies of the control current and the control resistor tend to cancel to provide a PTAT control voltage which is independent of the resistor temperature dependency. The output stage includes an output transistor coupled to the output constant current source such that the output current of the output stage has no current contribution other than from the output constant current source via the output transistor.

More particularly, a voltage controlled current source includes a pair of control constant current sources including a first control constant current source and a second control constant current source, a control resistor, a pair of control input transistors comprising a first transistor and a second transistor, a pair of control output transistors comprising a third transistor and a fourth transistor, a pair of voltage follower transistors comprising a fifth transistor and a sixth transistor, a pair of output transistors comprising a seventh transistor and an eighth transistor, and an output constant current source. The first control constant current source, the first transistor, and the third transistor are coupled in series such that them is a first node between the first current source and the first transistor, and a second node between the first transistor and the third transistor. The second control current source, the second transistor, and the fourth transistor, are coupled in series such that them is a third node between the second current source and the second transistor, and a fourth node between the second transistor and the fourth transistor. The control resistor is coupled between the second node and the fourth node. The fifth transistor serves as a voltage follower between the third transistor and the first node, and the sixth transistor serves as a voltage follower between the fourth transistor and the third node. The fourth transistor is coupled to the seventh transistor, and the eighth transistor is coupled to the third transistor. The output constant current source is coupled to the seventh and eighth transistors, such that a d.c. input voltage applied to the first transistor creates an output current from the seventh transistor that is essentially a constant fraction of the output constant current source.

A method for providing a current that is a constant fraction of an output constant current source includes the steps of: (a) developing a control current that is based on the same resistor type as a control resistor, (b) applying the control current to the control resistor to develop a PTAT control voltage that is proportional to absolute temperature and which is essentially independent of the temperature dependencies of the control resistor; and (c) applying the PTAT control voltage to a current divider coupled to an output constant current source, the current divider providing an output current which is essentially a constant fraction of the output constant current source.

The method and apparatus of the present invention therefore solve the problem of providing a voltage adjustable current source whose output is a stable fraction of total current available, regardless of any changes in the total current due to changes in temperature. In addition, the need for trimmer resistors is eliminated since the current source is voltage controlled.

These and other advantages of the present invention will become apparent to those skilled in the art upon a reading of the following descriptions of the invention and a study of the several figures of the drawing.

DETAILED DESCRIPTION OF THE PREFERRED EMBODIMENTS

Figure 1:
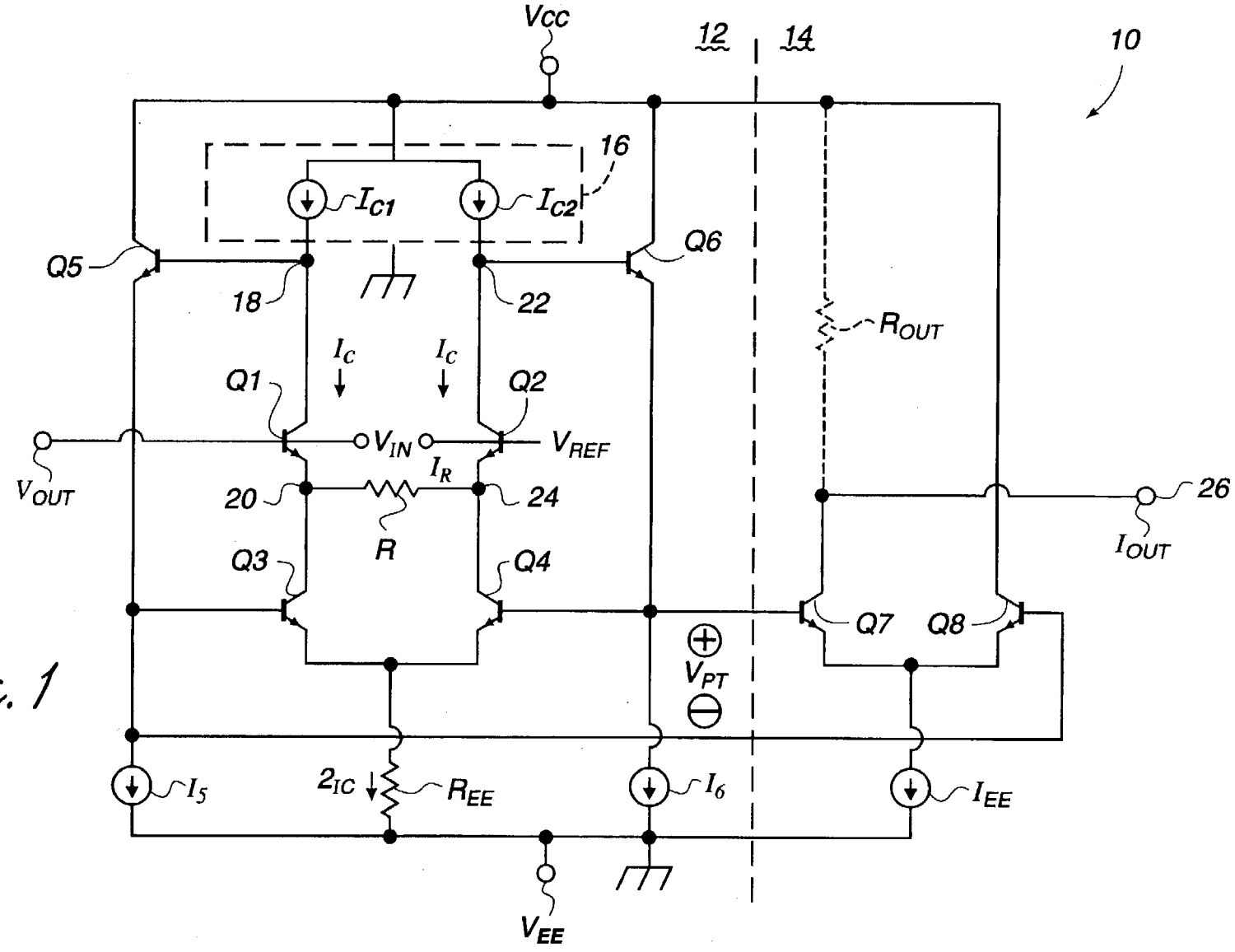
FIG. 1 is a schematic of a temperature-stabilized, constant fraction, voltage controlled current source in accordance with the present invention.

In FIG. 1, a temperature-stabilized, constant fraction, voltage controlled current source 10 in accordance with the present invention, includes a first stage 12 and a second stage 14. The first stage 12 (also referred to herein as the "control stage") produces a PTAT control voltage $V_{PT}$ that is proportional to absolute temperature (PTAT) from a stable input voltage ("control voltage") $V_{CONT}$. Again, as used herein "stable" means that it is essentially invariant with temperature. A second stage 14, also known as the "output stage" converts the PTAT control voltage $V_{PT}$ to an output current $I_{out}$ which is an essentially constant fraction (ranging from 0 to 1) of an output constant current source $I_{EE}$, as controlled by the voltage level of the $V_{CONT}$. In other words, as the current produced by current $I_{EE}$ varies with temperature, $I_{out}$ will likewise vary with temperature as a fixed fraction of the $I_{EE}$ value. It should be noted that the output current source itself is not necessarily PTAT. However, the PTAT control voltage assures that only a constant fraction of the of the output current source is output from the circuit of the present invention.

First or "control" stage 12 includes six transistors labeled Q1, Q2, Q3, Q4, Q5, and Q6. In this preferred embodiment, the transistors Q1–Q6 are bipolar NPN transistors. The design and fabrication of bipolar transistors in analog integrated circuits is well known to those skilled in the art. Preferably, transistors that are paired with each other are of about the same size and operating characteristics, i.e., transistors Q1 and Q2 (first and second "input transistors", respectively) are matched in operating characteristics, transistors Q3 and Q4 (first and second "control transistors", respectively) are matched in operating characteristics, and transistors Q5 and Q6 (first and second "feedback transistors", respectively) are matched in operating characteristics. In the present embodiment, transistors Q1–Q6 can be essentially the same types of transistors, i.e. they can all be matched, if desired.

The control stage 12 further includes a number of current sources. More particularly, control stage 12 includes a matched dual current source 16 including a first current source $I_{c1}$ and a second current source $I_{c2}$, and a pair of biasing current sources $I_5$ and $I_6$. The control stage 12 further includes a temperature-dependent control resistor R and an output current source biasing or "headroom" resistor $R_{EE}$.

As seen in FIG. 1, the matched current source 16 is coupled between $V_{cc}$ and the input transistors Q 1 and Q2. Both current sources $I_{c1}$ and $I_{c2}$ produce a current $I_c$ for a total current of $2I_c$. A preferred implementation of matched dual current source 16 will be discussed subsequently with reference to FIG. 2.

$I_{c1}$, Q1, and Q3 are coupled in series such that a first node 18 is formed between current source $I_{c1}$ and transistor Q1, and such that a second node 20 is formed between transistor Q1 and transistor Q3. By "series" it is meant that they are coupled together such that current flows from the current source and serially through the transistors to ground. More particularly, the output of current source $I_{c1}$ is coupled to the collector of bipolar transistor Q1, and the emitter of transistor Q1 is coupled to the collector of transistor Q3. The emitter of transistor Q3 is coupled to ground through resistor $R_{EE}$. In a similar fashion, current source $I_{c2}$, transistor Q2, and transistor Q4 are coupled in series to create a third node 22 between current source $I_{c2}$ and transistor Q2, and a fourth node 24 between transistor Q2 and transistor Q4. More particularly, the output of current source $I_{c2}$ is coupled to the collector of transistor Q2, and the emitter of transistor Q2 is coupled to the collector of transistor Q4. The emitter of transistor Q4 is coupled to ground through resistor $R_{EE}$.

Transistors Q5 and Q6 are voltage follower or "feedback" transistors that are coupled between $V_{CC}$ and the bases of transistors Q3 and Q4, respectively. More particularly, the collectors of transistors Q5 and Q6 are coupled to $V_{CC}$, while the emitter of transistor Q5 is coupled to the base of transistor Q3 and the emitter of transistor Q6 is coupled to the base of transistor Q4. The bases of transistors Q5 and Q6 are coupled to nodes 18 and 22, respectively. The base of transistor Q1 is coupled to an input voltage $V_{CONT}$, and the base of transistor Q2 is coupled to a reference voltage $V_{REF}$. A voltage $V_{IN}=V_{CONT}-V_{REF}$ is developed between the bases of Q1 and Q2.

The emitters of transistors Q3 and Q4 are coupled together, and are coupled to $V_{EE}$ (ground) by biasing resistor $R_{EE}$. The emitter of transistor Q5 and the base of transistor Q3 are coupled to $V_{EE}$ by a current source 15, and the emitter of transistor Q6 and base of transistor Q4 are coupled to $V_{EE}$ by a current source $I_6$. As noted above, a PTAT voltage $V_{PT}$ which is proportional to absolute temperature is developed across the bases of transistors Q3 and Q4.

The second or "output" stage 14 includes transistors Q7 and Q8 and an output constant current source $I_{EE}$. Transistors Q7 and Q8 are preferably matched in operating characteristics, and are preferably NPN bipolar transistors. The base of transistor Q7 is coupled to the base of transistor Q4, and the base of transistor Q8 is coupled to the base of transistor Q3. The collector of transistor Q8 is coupled to $V_{CC}$, and the emitters of transistors Q7 and Q8 are coupled to $V_{EE}$ by the output constant current source $I_{EE}$. The collector of transistor Q7 produces an output current $I_{OUT}$ at an output node 26 or, alternatively, a voltage $V_{OUT}$ at the output node 26 with the addition of an output resistor $R_{OUT}$ connected between the collector of transistor Q7 and $V_{CC}$. The resistor $R_{OUT}$ is not present when operating the circuit as a current source. As will be discussed in greater detail subsequently, transistors Q7 and Q8 serve as current dividers to determine which fractional proportion (between 0 and 1) of the output current source $I_{EE}$ is to be provided at node 26.

Briefly, the first stage 12 is used to set up the fractional component of $I_{EE}$ that is to be output at node 26, while the second stage 14 performs the necessary division. $V_{IN}$, as presently implemented, can be varied in the range of about ±200 millivolts (mV), or 0.2 volts d.c. As noted previously, $V_{IN}$ is the difference between the input control voltage $V_{CONT}$ and the reference voltage $V_{REF}$. When $V_{IN}$ equals zero, them is no current in resistor R and the currents flowing through the transistors Q1 and Q2 are about the same as the currents flowing through the transistors Q2 and Q4. Therefore, when $V_{IN}$ equals zero, $V_{PT}$ equals zero, and the current $I_{EE}$ will be equally split between transistors Q7 and Q8, i.e. $I_{OUT}$ equals one-half $I_{EE}$. If $V_{IN}$ goes negative, $I_{OUT}$ will decrease until it is at essentially zero when $V_{IN}$ is in the bottom of its range (e.g., at −200 mV in this example). As $V_{IN}$ increases in a positive direction, $I_{OUT}$ will increase until it reaches $I_{EE}$ when $V_{IN}$ is at the top of its range (e.g., at about −200 mV in this example).

The operation of a circuit 10 of the present invention will now be discussed in greater detail. As noted in FIG. 1, the collector currents $I_C$ in transistors Q1 and Q2 are equal. Because the collector currents are equal, the base-emitter voltages of the two transistors are equal and the entire input voltage, $V_{IN}$, appears without error across the resistor R. The current $I_R$ flowing in the resistor R is therefore necessarily the difference in collector currents flowing through transistors Q3 and Q4. Negative feedback from the collectors of transistors Q1 and Q2 through the voltage follower transistors Q5 and Q6 set up the proper voltage across the bases of transistors Q3 and Q4, respectively, to properly maintain the difference in their collector currents.

In the present invention, $V_{IN}$ is considered to be stable by definition. Again, by "stable" it is meant heroin that $V_{IN}$ does not vary with temperature. $V_{IN}$ is provided by other circuitry as not a part of the present invention, and can be provided either on-chip or off-chip. In the preferred embodiment of this present invention, $V_{IN}$ is selected to determine a desired fractional output current from transistor Q7. Therefore, $V_{IN}$ can, to some extent, be considered to be variable in that the circuit designer can determine the actual value of $V_{IN}$ within a designated range. However, during operation, $V_{IN}$ would be varied only to establish a new fractional current output to adjust the d.c. bias of a connected signal circuit.

Since $V_{IN}$ is stable by definition, the current $I_R=V_{IN}/R$ is stable only if R is stable, which is not usually the case. The equations for the currents in transistors Q3 and Q4 are:

$$I_{c4}=I_c+I_R \quad \text{(Equation 1)}$$

$$I_{c3}=I_c-I_R \quad \text{(Equation 2)}$$

$$I_{c4}/I_{c3}=(I_c+I_R)/(I_c-I_R) \quad \text{(Equation 3)}$$

If $I_C$ is made to have the same temperature dependency as $I_R$, as will be discussed in greater detail with reference to FIG. 2, the ratio $I_{c4}/I_{c3}$ will have no temperature dependency and will remain stable over temperature. This stable ratio of currents results in a voltage across the bases Q3–Q4 (labeled VPT in FIG. 1), which is proportional to absolute temperature (PTAT) in nature. More particularly, the following relations hold:

$$V_{PT}=V_{be4}-V_{be3} \quad \text{(Equation 4)}$$

$$V_{be3}=V_T\ln(I_{c3}/I_S) \quad \text{(Equation 5)}$$

$$V_{be4}=V_T\ln(I_{c4}/I_S) \quad \text{(Equation 6)}$$

$$I_{c4}/I_{c3}=e^{[(V_{be4}-V_{be3})/V_T]}=e^{(V_{PT}/V_T)} \quad \text{(Equation 7).}$$

Since, by definition, the ratio $I_{c4}/I_{c3}$ is constant with temperature, equation 7 indicates that the ratio $V_{PT}/V_T$ must remain constant over temperature. $V_T$ is the PTAT thermal voltage which, as is well known to those skilled in the art, is given by the equation $V_T=kT/q$, where k is the Boltzmann constant, T is the absolute temperature, and q is the charge on an electron. Since $V_T$ must be PTAT, $V_{PT}$ must also be PTAT to maintain a constant ratio in the exponent of Equation 7.

The PTAT control voltage $V_{PT}$ is coupled to the bases of the differential pair ("current divider") transistors Q7 and Q8, and will cause the current proportions $I_{C7}/I_{C8}$ to equal the current proportions $I_{C4}/I_{C3}$. In consequence, as noted below, the ratio of the output current to the code total available current ($I_{C7}/I_{EE}$) is constant, regardless of changes in the total current $I_{EE}$.

$$I_{c7}+I_{c8}=I_{EE}, \quad \text{(Equation 8)}$$

$$I_{c7}/I_{c8}=e^{(V_{PT}/V_T)}=c \text{ (c is a constant)} \quad \text{(Equation 9)}$$

$$I_{c7}/(I_{EE}-I_{c7})=c \quad \text{(Equation 10)}$$

$$I_{c7}/I_{EE}=c/(1+c)=d \text{ (d is a constant)} \quad \text{(Equation 11)}$$

The relation of the fraction $I_{c7}/I_{EE}$ to the stable input voltage can therefore be derived as follows:

$$I_{c7}/I_{EE}=I_{c4}/(2*I_c)=(I_c+I_R)(2*I_c)=½+(V_{IN}/R)(2*I_c) \quad \text{(Equation 12)}$$

$$I_{c7}/I_{EE}=½+V_{IN}/(2*I_c*R) \text{ where } -I_c*R<V_{IN}<I_c*R \quad \text{(Equation 13)}$$

It can therefore be seen that $I_{c7}=I_{OUT}$ is a stable fraction of $I_{EE}$. If IEE tends to vary with temperature, $I_{OUT}$ will be a stable fraction of $I_{EE}$ over temperature. Since many modem analog integrated circuits are designed to operate in a temperature range spanning about 100° C., it must be anticipated that the current produced by a constant current source $I_{EE}$ can vary by as much as a factor of 2 within that temperature range. The fractional output $I_{OUT}$ will vary accordingly with the variance in output current of constant current source $I_{EE}$.

As noted, $I_{OUT}/I_{EE}$ equals $½+V_{IN}/(2*I_C*R)$. Therefore, as noted previously, when $V_{IN}$ equals zero, $I_{OUT}$ equals one-half $I_{EE}$. When $V_{IN}$ equal to $I_C*R$, $I_{OUT}$ equals $I_{EE}$, and when $V_{IN}$ equals minus $I_C*R$, $I_{OUT}$ equals zero.

The actual value for the various components in circuit 10 are dependent upon the application of the circuit, as will be appreciated by those skilled in the art. Typically, $V_{CC}$ is 2.5 volts d.c or more, e.g., 3 volts, 5 volts, etc. $V_{EE}$ is usually at about 0 volts d.c. (ground). Current sources $I_{c1}$ and $I_{c2}$ can be, for example, 100 microampere current sources, and the control resistor R can be, for example, about 2 K ohm. For these values, $V_{IN}$ would operate in a range of ±0.2 volts (i.e. ±200 mV, as in the current example), and $V_{REF}$ is at about 2 volts. $I_{EE}$ can be virtually any constant current source that is to be "divided", and current sources $I_5$ and $I_6$ (first and second "standing current" sources, respectively) are simply small current sources (e.g., 20 microampere current sources), that provide a standing current through transistors Q5 and Q6. If $I_{EE}$ is chosen as a 100 microampere current source, $I_{OUT}$ will be limited to 100 microamperes, and a 10 kiloohm ohm (kΩ) resistor $R_{OUT}$ will provide a 0–1 volt d.c. constant output voltage at node 26. The resistor $R_{EE}$ (which provides a path for the current $2I_{C1}$ to ground), is provided to create "headroom" of, for example, ½ volt across the output constant current source $I_{EE}$. This is because the voltage across $R_{EE}$ is the same as the voltage across current source $I_{EE}$, since the voltage on the emitter of transistor Q4 is mirrored to the emitter of transistor Q7. This "headroom" is required because real-world (non-ideal) current sources need a small voltage across them in order to operate. In this example, $R_{EE}$ would be about 2.5 kilohms.

Figure 2:
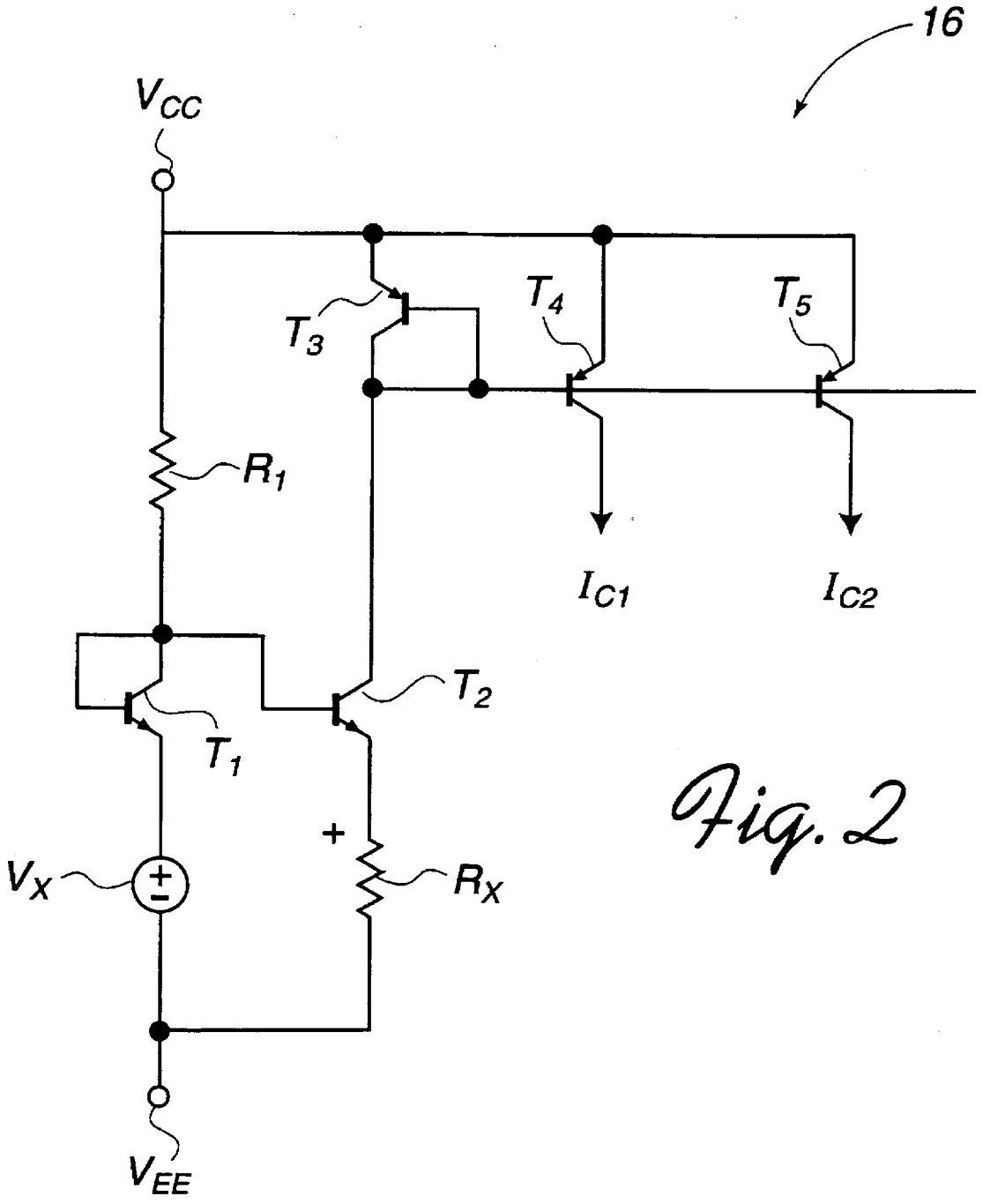
FIG. 2 is a schematic of a temperature-stabilized constant current source of the present invention that can be used in the circuit of FIG. 1.

In FIG. 2, a preferred matched pair current source 16 is illustrated in greater detail. The circuit 16 includes two NPN bipolar transistors T1 and T2, and three PNP bipolar transistors T3, T4, and T5. The matched current source 16 also includes a stable (constant with temperature) voltage source $V_X$, a resistor R1, and a temperature-dependent resistor $R_X$. As will be discussed in greater detail subsequently, it is essential for the present invention that the resistor $R_X$ have similar temperature characteristics to the resistor R of FIG. 1.

As seen in FIG. 2, resistor R1, transistor T1, and voltage source $V_X$ are coupled in series between $V_{CC}$ and $V_{EE}$. More particularly, the collector of transistor T1 is coupled to $V_{CC}$ by resistor R1, and the emitter of transistor T1 is coupled to $V_{EE}$ by stable voltage source $V_X$. The base of transistor T1 is coupled to its collector.

As also seen in FIG. 2, transistor T3, transistor T2, and resistor $R_X$ are also coupled in series between $V_{CC}$ and $V_{EE}$. More particularly, the emitter of transistor T3 is coupled to $V_{CC}$, the collector of transistor T3 is coupled to the collector of transistor T2, and the emitter of transistor T2 is coupled to $V_{EE}$. (ground) by resistor $R_X$. The base of transistor T2 is coupled to the collector and base of transistor T1.

The base of transistor T3 (the "diode-connected transistor") is coupled to its collector to form one-half of a current mirror. Each of transistors T4 and T5 (first and second "mirrored" transistors, respectively) form the other half of a current mirror with the transistor T3. The bases of transistors T4 and T5 are coupled to the collector and base of transistor T3, while the emitters of transistors T4 and T5 are coupled to $V_{CC}$. The collector of transistor T4 creams the current $I_{C1}$, and the collector of transistor T5 forms the current $I_{C2}$. Since both of these currents $I_{C1}$ and $I_{C2}$ are mirrored with the same transistor T3, they are essentially the same currents, i.e., they are both essentially identical currents each with a magnitude of $I_C$.

As noted above, $V_X$ is a stable (i.e., does not vary with temperature) voltage source. The design and manufacture of such voltage sources are well known to those skilled in the art, and can be provided to either on-chip or off-chip. A typical circuit for producing $V_X$ is includes band-gap generator, as is known to those skilled in the art of analog circuit design. $R_1$ in FIG. 2 is simply provided to limit the current through transistor T1 and voltage source $V_X$ although, for best performance, R1 should be chosen so that its nominal current approximates the current in $R_X$. Transistors T1 and T2 serve to reproduce the voltage $V_X$ across the resistor $R_X$. This is because the base-emitter voltages of transistors T1 and transistors T2 are very nearly equal, so that a voltage very nearly equal to $V_X$ will appear across the emitter of transistor T2, and this voltage $V_X$ appears across the resistor $R_X$.

Because $V_X$ is constant, the current $V_X/R_X$ will change over temperature only as $R_X$ changes. As used herein, this will be referred to as a "constant current based on resistor type R." The current $V_X/R_X$ flows into the collector of T2 and into the collector of transistor T3. As will be appreciated by those skilled in the art, the transistor T3 is connected to form a diode, i.e. is "diodeconnected." Because the base-emitter voltages of transistors T3, T4 and T5 are identical, the same current which flows in the collector of T3, i.e., $V_X/R_X$, will flow in the collectors of transistor T4 and transistor T5, as noted previously.

It is essential to the proper operation of the present invention that the matched dual current source 16 is based on the same resistor technology as the resistor R of FIG. 1. As will be appreciated to those skilled in the art, there are many types of resistor technologies (also referred to herein as resistor "types") that can be provided on an integrated circuit. For example, in the book *Analysis and Design of Analog Integrated Circuits,* 2nd edition, P. Grey et al., John Wiley & Sons, ©1977, 1978, a number of resistor technologies are described including, for example, base-diffused, emitter-diffused, pinched, epitaxial, pinched epitaxial, and thin film resistors. It is not important to the present invention which resistor technology is chosen, as long as the resistor technology chosen for resistor $R_X$ in FIG. 2 and resistor R in FIG. 1 is the same. This will ensure that their temperature dependencies are the same, allowing for the noted cancellation and the production of the PTAT voltage $V_{PT}$. If different resistor technologies are used for $R_X$ in FIG. 2 and resistor R in FIG. 1, then the voltage $V_{PT}$ would not be PTAT, and the circuit of the present invention would not work as desired.

Figure 3:
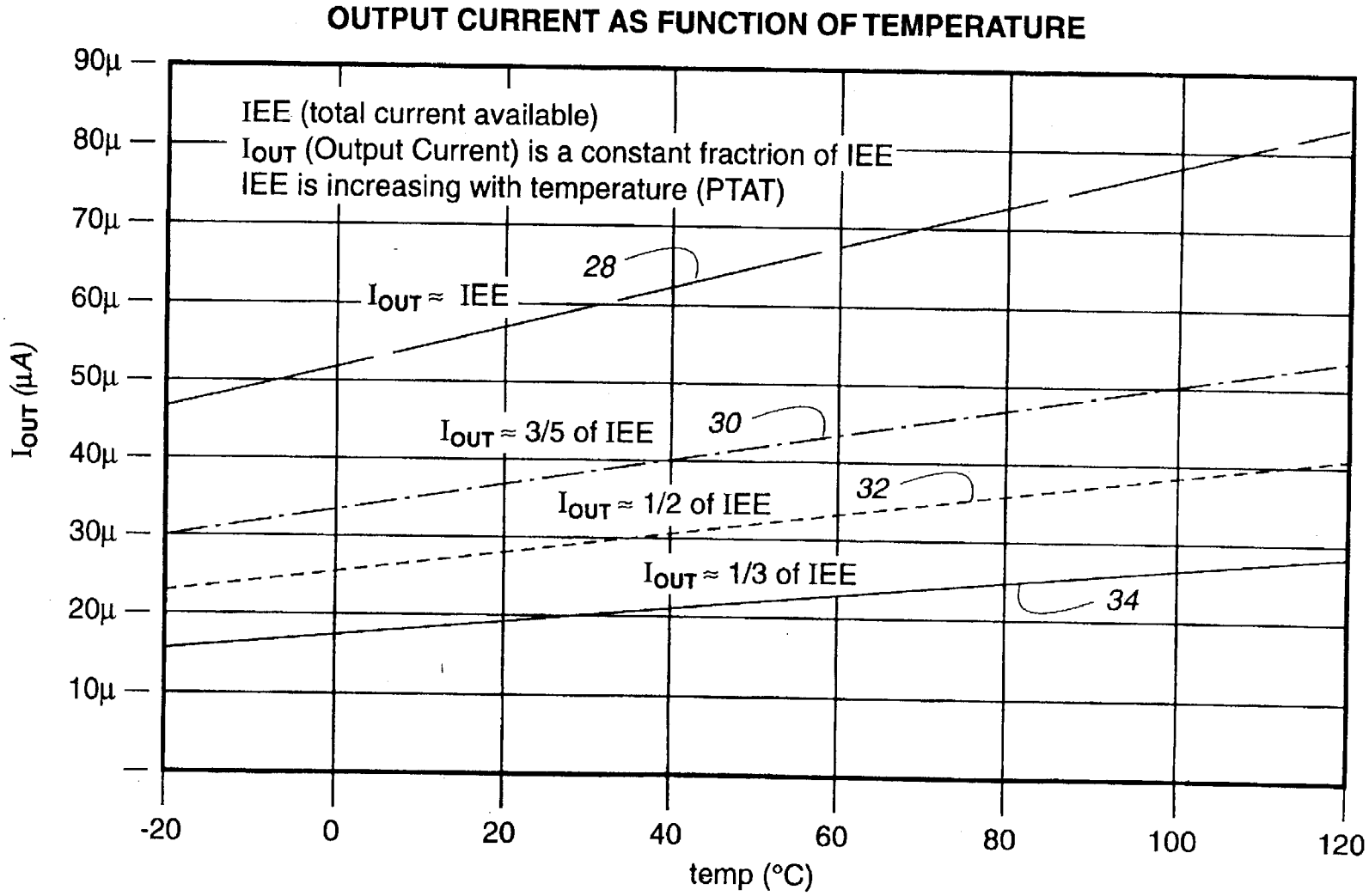
FIG. 3 is a graph illustrating the output current of the circuit of FIG. 1 as a function of temperature and for several input voltages.

FIG. 3 is a graph illustrating the output current $I_{OUT}$ as a function temperature T for a number of voltages $V_{IN}$. This graph was developed using a SPICE simulator as applied to the circuit of FIG. 1. Along the vertical axis is the current $I_{OUT}$ in microamperes, and along the horizontal axis is the temperature in degrees Celsius. A first curve 28 where $I_{OUT}$ is equal to $I_{EE}$, i.e., where the input voltage $V_{IN}$ is at the maximum end of its range. A curve 30 shows $I_{OUT}$ to be approximately a constant ⅗ of $I_{EE}$, as set by and input voltage $V_{IN}$ greater than zero. In a curve 32, $I_{OUT}$ is approximately equal to ½ of $I_{EE}$, i.e., the input voltage $V_{IN}$ equals zero volts d.c. Finally, a curve 34 illustrates $I_{OUT}$ approximately equal to ⅓ of $I_{EE}$, i.e., the input voltage $V_{IN}$ is less than zero.

As noted in FIG. 3, the various $I_{OUT}$ curves 28–34 are not parallel. This is because they are fractions of the maximum output $I_{EE}$ (where curve 28 is a 100% fraction) and, accordingly, their slopes vary. However, the currents $I_{OUT}$ remain a constant, fixed fraction of the total current available from current source $I_{EE}$, as the total current available from the source $I_{EE}$ varies with temperature.

The circuit and method of the present invention can, and typically do, form a part of a larger system and/or process. For example, the circuit of the present invention typically forms a part of a larger circuit that is integrated on a "chip" and packaged. The packaged integrated circuit is then made a part of a larger system by attaching it to a printed circuit (PC) board along with other electronic devices, connecting the resultant circuit to power supplies and to other devices and systems. It should therefore be understood for the product that results from the processes of the present invention include the circuit itself, integrated circuit chips including one or more circuits, larger systems (e.g. PC board level systems), products which include such larger systems, etc.

While this invention has been described in terms of several preferred embodiments, it is contemplated that alternatives, modifications, permutations and equivalents thereof will become apparent to those skilled in the art upon a reading of the specification and study of the drawings. It is therefore intended that the following appended claims include all such alternatives, modifications, permutations and equivalents as fall within the true spirit and scope of the present invention.

What is claimed is:

1. A temperature stabilized, constant fraction, voltage controlled current source comprising:

a control stage responsive to a stable, d.c. input voltage, said control stage including a temperature dependent control resistor of a given resistor technology, and at least one control constant current source providing said control resistor with a control current, wherein said control constant current source includes a temperature dependent current source resistor based upon said given resistor technology such that said control current is similarly temperature dependent, and such that the temperature dependencies of said control current and said control resistor tend to cancel to provide a PTAT control voltage that is proportional to absolute temperature; and an output stage responsive to said PTAT control voltage, said output stage including an output transistor coupled to an output constant current source, wherein an output current of said transistor stage taken from said output transistor has no current contribution other than from said output constant current source, such that said control voltage causes said output transistor to output an essentially constant fraction of said output constant current source as said output current.

2. A temperature stabilized, constant fraction, voltage controlled current source as recited in claim 1 wherein said control constant current source is a first control constant current source providing a first control current, and further comprising a second control constant current source also including a current source resistor based upon said given resistor technology and supplying a second control current to said control resistor.

3. A temperature stabilized, constant fraction, voltage controlled current source as recited in claim 2 wherein said first control current is supplied to a first side of said control resistor, and wherein said second control current is supplied to a second side of said control resistor.

4. A temperature stabilized, constant fraction, voltage controlled current source as recited in claim 3 wherein said first control current is supplied via a first input transistor that is controlled by an input control voltage, and wherein said second control current is supplied via a second input transistor that is controlled by a reference voltage.

5. A temperature stabilized, constant fraction, voltage controlled current source as recited in claim 4 wherein said first side of said control resistor is coupled by a first control transistor towards ground, and wherein said second side of said control resistor is coupled by a second control transistor towards ground.

6. A temperature stabilized, constant fraction, voltage controlled current source as recited in claim 5 further comprising a first feedback transistor controlled by said first control constant current source and controlling said first control transistor, and a second feedback transistor controlled by said second control constant current source and controlling said second control transistor.

7. A temperature stabilized, constant fraction, voltage controlled current source as recited in claim 6 further comprising a rust standing current source coupling said first feedback transistor to ground, and a second standing current source coupling said second feedback transistor to ground.

8. A temperature stabilized, constant fraction, voltage controlled current source as recited in claim 5 wherein said output transistor is a first output transistor, and further comprising a second output transistor coupled to said first output transistor and said output constant current source to form a current divider with said first output transistor, said first output transistor being coupled to said second control transistor.

9. A temperature stabilized, constant fraction, voltage controlled current source as recited in claim 8 further comprising a headroom resistor coupling said first control transistor and said second control transistor to ground, said headroom resistor providing a biasing voltage for said output constant current source.

10. A temperature stabilized, constant fraction, voltage controlled current source as recited in claim 2 wherein said first control constant current source and said second control constant current source are a matched pair of constant current sources.

11. A temperature stabilized, constant fraction, voltage controlled current source as recited in claim 10 wherein said control constant current source includes a diode-connected transistor, a first mirrored transistor coupled to said diode-connected transistor to provide said first control current, and a second mirrored transistor coupled to said diode-connected transistor to provide said second control current, such said first control current and said second control current are of essentially the same value.

12. A temperature stabilized, constant fraction, voltage controlled current source as recited in claim 11 wherein said diode-connected transistor is coupled in series with said current source resistor.

13. A voltage controlled current source comprising:

a pair of control constant current sources comprising a first control constant current source and a second control constant current source, a control resistor, a pair of control input transistors comprising a first transistor and a second transistor, a pair of control output transistors comprising a third transistor and a fourth transistor, a pair of feedback transistors comprising a fifth transistor and a sixth transistor, a pair of output transistors comprising a seventh transistor and an eighth transistor, and an output constant current source;

wherein said first control constant current source, said first transistor, and said third transistor are coupled in series such that there is a first node between said first current source and said first transistor and a second node between said first transistor and said third transistor, wherein said second control constant current source, said second transistor, and said fourth transistor are coupled in series such that there is a third node between said second current source and said second transistor and a fourth node between said second transistor and said fourth transistor, wherein said control resistor is coupled between said second node and said fourth node, wherein said fifth transistor is coupled between said third transistor and said first node, wherein said sixth transistor is coupled between said fourth transistor and said third node, wherein said fourth transistor is coupled to said seventh transistor, wherein said eight transistor is coupled to said third transistor, and wherein said output constant current source is coupled to said seventh and eighth transistors;

such that a d.c. input voltage applied to said first transistor creates an output current from said seventh transistor which is essentially a constant fraction of said output constant current source.

14. A voltage controlled current source as recited in claim 13 wherein said first control constant current source comprises a first mirrored transistor coupled to a diode-connected transistor, and wherein said second control constant current source comprises a second mirrored transistor coupled to said diode-connected transistor.

15. A voltage controlled current source as recited in claim 14 wherein said diodeconnected transistor is coupled in series with a temperature dependent current source resistor that is based upon the same resistor technology as said control resistor, such that a voltage developed between said third and fourth transistors is proportional to absolute temperature (PTAT).

16. A method for providing a current that is a constant fraction of an output constant current source comprising the steps of:

developing a control current employing a first resistor said first resistor being of a given resistor technology.

applying said control current to it control resistor to develop a PTAT control voltage that is proportional to absolute temperature and which is essentially independent of temperature dependencies of said control resistor, said control resistor also being of said given resistor technology; and applying said PTAT control voltage to a current divider coupled to an output constant current source, said current divider providing an output current which is essentially a constant fraction of said output constant current source over a range of operating temperatures.

17. A method for providing a current that is a constant fraction of an output constant current source as recited in claim 16 wherein said step of developing a control current includes the steps of developing a first control current with a first constant current source and applying said first control current to a first side of said control resistor, and developing a second control current with a second constant current source and applying said second control current to a second side of said control resistor, said first constant current source and said second constant current source being based upon said same resistor type as said control resistor.

18. A method for providing a current that is a constant fraction of an output constant current source as recited in claim 17 wherein said output current includes essentially no current except current derived from said output constant current source.

19. A method for providing a current that is a constant fraction of an output constant current source as recited in claim 17 further comprising the step of coupling an output resistor to said output current to derive an output voltage.

* * * * *

UNITED STATES PATENT AND TRADEMARK OFFICE

CERTIFICATE OF CORRECTION

PATENT NO. : 5,672,961
DATED : September 30, 1997
INVENTOR(S) : Entrikin et al.

It is certified that error appears in the above-identified patent and that said Letters Patent is hereby corrected as shown below:

Column 2, line 18, change "Koeyama" to --Koyama--

Column 3, line 20, change "them" to --there--

Column 3, line 24, change "them" to --there--

Column 7, line 12, change "modem" to --modern--

Column 8, line 13, change "creams" to --creates--

Column 8, line 40, change "diodeconnected" to --diode-connected--

CLAIMS:

Column 10, line 33, change "rust" to --first--

Column 11, line 44, change "diodeconnected" to --diode-connected--

Column 12, line 9, insert --,-- after "resistor"

Column 12, line 10, after "technology", change "." to --;--

Column 12, line 11, change "it" to --a--

Signed and Sealed this

Twenty-second Day of June, 1999

*Attest:*

Q. TODD DICKINSON

*Attesting Officer*

*Acting Commissioner of Patents and Trademarks*